United States Patent [19]

Frank

[11] Patent Number: 4,624,428

[45] Date of Patent: Nov. 25, 1986

[54] SPRING RAIL FROG

[75] Inventor: Earl E. Frank, Tallman, N.Y.

[73] Assignee: Abex Corporation, Stamford, Conn.

[21] Appl. No.: 652,546

[22] Filed: Sep. 20, 1984

[51] Int. Cl.[4] ..... B61L 11/02

[52] U.S. Cl. ..... 246/276; 246/468

[58] Field of Search ..... 246/276, 468, 275, 274, 246/270 R, 290, 291, 319, 320 R, 465, 385, 434; 104/130

[56] References Cited

U.S. PATENT DOCUMENTS

| | | | |
|---|---|---|---|
| 362,158 | 5/1887 | Hope, Jr. | 246/319 |
| 497,455 | 5/1893 | Neafie | 246/276 |
| 2,174,367 | 9/1939 | Hoffman | 246/276 X |

FOREIGN PATENT DOCUMENTS

| | | | |
|---|---|---|---|
| 22996 | 8/1905 | Austria | 246/385 |
| 1124537 | 3/1962 | Fed. Rep. of Germany | 104/130 |

*Primary Examiner*—Robert B. Reeves
*Assistant Examiner*—Glenn B. Foster
*Attorney, Agent, or Firm*—Thomas S. Baker, Jr.

[57] ABSTRACT

A railroad spring frog assembly for trackwork installations includes a rigid rail and a flexible spring wing rail. The flexible spring wing rail is rigidly affixed between one end which engages a wing point rail and the other end which connects to a closure rail at the toe end of the frog support means. When a rail car enters the frog and a wheel flange engages the spring wing rail to pass between it and the long point rail the spring wing rail bends away from the long point rail to define a flangeway therebetweeen.

5 Claims, 1 Drawing Figure

SPRING RAIL FROG

BACKGROUND OF THE INVENTION

This invention relates to railroad trackwork. More specifically, it relates to a frog of the spring rail type which is principally used at turn-outs from main line track.

A railroad frog is a device which is introduced at the intersection of two running rails to permit the flanges of railroad car wheels moving along one of the rails to pass across the other rail. The frog supports the wheels over the missing tread surface between the throat and the point of frog, and provides flangeways for the flanges of car wheels which pass through the frog.

Standard turnout frogs are generally either rigid frogs which have no movable parts or movable wing frogs in which one or both of the wings move outward to provide flangeways. A spring rail frog is a movable wing frog in which one of the wings moves outward to provide a flangeway. A spring rail frog is right-hand when the wing moves to the right looking from the toe toward the point of frog and left-hand when the wing moves to the left looking from the toe toward the point of frog. A spring rail frog is preferred over a rigid frog for turn-outs from a main line track. The reason for this is that a spring rail frog provides a practically continuous rail for the main line track and is smoother than a rigid frog.

A standard spring rail frog includes a rigid wing rail which is substantially aligned with a long point or heel rail connected to a turnout traffic rail and a movable spring wing rail which is substantially aligned with a short point or heel rail which is connected to a main line traffic rail. The rigid wing rail is connected at one end to a curved closure rail and the spring wing rail is connected at one end to a straight closure rail. The spring wing rail is spring biased against the long point rail and provides a substantially continuous support for the wheels of a car passing along the main line track. The spring wing rail is moved laterally away from the long point rail to provide a flangeway between the long point rail and the spring wing rail when a wheel of a car traversing the long point or rigid wing rail engages the spring wing rail and forces it to move laterally.

Spring rail frogs currently in use are interconnected with rail trackwork by mechanically connecting the long point and short point rails at the heel end of the frog with a turn-out and a main line rail, respectively, and by mechanically connecting the spring wing rail and rigid wing rail at the toe end of the frog with a straight closure rail and a curved closure rail, respectively. The end of the spring wing rail abutts the end of the straight closure rail to form a first joint and the two rails are mechanically connected. Similarly, the end of the rigid wing rail abutts the end of the curved closure rail to form a second joint and these two rails are mechanically connected. The first and second joints between the spring wing rail and the straight closure rail and the rigid wing rail and the curved closure rail are caled toe joints. One common mechanical connection for a toe joint includes a toe block having a base and a pair of lateral sidewalls. This connection is shown in American Railway Engineering Association (AREA) plan number 490-82. In that connection the toe block is positioned such that one lateral sidewall overlies the first toe joint and engages the inner sides of the webs of each of the spring wing rail and the straight closure rail.

The other sidewall overlies the second toe joint and engages the inner sides of the webs of each of the rigid wing rail and the curved closure rail. A first joint bar overlies the first toe joint and engages the outer sides of the webs of the spring wing rail and the straight closure rail. A plurality of track and shoulder bolts pass through aligned bores in the one lateral wall of the toe block, in the spring wing rail web and in the first joint bar to thereby clamp the spring wing rail between the toe block and the joint bar. Track and shoulder bolts also pass through aligned bores in the toe block, the straight closure rail web and the first joint bar to clamp the straight closure rail between the first joint bar and the toe block. In this manner the spring wing rail is mechanically connected to the straight closure rail. Similarly, a second joint bar overlies the second toe joint and engages the outer sides of the webs of the rigid wing rail and the curved closure rail. A plurality of track bolts pass through aligned bores in the other lateral wall of the toe block, the rigid wing rail web and the second joint bar to clamp the rigid wing rail between the toe block and the joint bar. Track bolts also pass through aligned bores in the other lateral wall of the toe block, the web of the curved closure rail and the second joint bar to clamp the curved closure rail between the toe block and the second joint bar. In this manner, the rigid wing rail is mechanically joined to the curved closure rail. The function of the toe block in addition to providing a clamping surface for the rails is to maintain a specified angle between the spring wing rail and the rigid wing rail at the toe joint.

The spring wing rail must be movable laterally a distance of approximately two inches at the half inch point of frog when it is engaged by the flange of a car wheel traversing the long point rail or the curved closure rail to provide a flangeway for the wheel. To do this, the spring wing rail is hinged or pivoted at the first toe joint. In order to permit the spring wing rail to pivot at the toe joint a certain amount of clearance between the first joint bar and the spring wing rail web is provided. Additionally, the amount of clearance between the joint bar and the web of the spring wing rail must increase as the distance from the toe joint increases. This is obvious since the lateral movement of the spring wing rail along its length will increase from zero at the toe joint to 2 inches at the half inch point of frog. A plurality of stops, hold downs, and horns and a spring box are spaced laterally along the length of the spring wing rail and are positioned to prevent the spring wing rail from moving laterally more than two inches at the half inch point of frog. The spring box biases the spring wing rail tightly against the long point rail. It is adjusted so that approximately 700 pounds of force applied laterally to the spring wing rail by a rail car wheel flange at the half inch point of frog will cause the rail to move two inches at that point. The horns also provide a vertical restraint for the spring wing rail.

A disadvantage with a bolted mechanical toe joint which connects the spring wing rail with the straight closure rail is that such a joint because it must allow the spring wing rail to pivot provides little resistance to vertical movement of the spring wing rail. Thus, numerous vertical hold downs or horns are required in order to prevent vertical movement of the spring wing rail. A second problem with the bolted toe joint is that it causes a relatively rough ride as a rail car traverses the frog. One reason for this is that the spring wing rail must be relatively short in order to prevent its being so heavy that a spring box cannot generate sufficient force to maintain the movable end of the rail in contact with the long point rail with sufficient force. A short rail interrupts the natural frequency of the track. If the force of the spring box necessary to maintain the spring wing rail in contact with the long point rail becomes too high, it may actually deform the rail when it is engaged by a car wheel which is undesirable. However, a high force biasing the spring wing rail against the long point rail is desirable to ensure that debris such as rocks trapped between the spring wing rail and the long point rail do not prevent closure therebetween.

It is desirable to provide a spring rail frog in which the pivotal toe joint between the spring wing rail and the straight closure rail is eliminated. Additionally, it is desirable to provide a spring wing rail which will engage the long point rail with increased force without having to increase the force exerted on the rail by a spring box. Further, it is desirable to provide a spring wing rail of increased length to cooperate with the non-pivotal joint to provide a smoother ride for a wheel which traverses the frog.

SUMMARY OF THE INVENTION

The instant invention is directed to a railroad frog assembly adapted to be inserted between a pair of traffic rails and a pair of closure rails and includes a support means, a long point rail mounted on the support means, a short point rail mounted on the support means and joined to the long point rail at the angle of frog to form the half-inch point of frog, a heel block mounted on the support means between the long point rail and the short point rail for maintaining the frog angle and the spacing between the long point rail and the short point rail, a rigid wing rail mounted on the support means having a flared end and a closure rail engaging end and a flexible spring wing rail having a free end which is movable between a first position in which it engages the long point rail and a second position in which it is spaced from the long point rail to provide a flangeway therebetween and a closure rail engaging end. The flexible spring wing rail is in the first position when it is relatively unstressed and is in the second position when it is stressed by a lateral force applied to it by the flange of a rail car wheel traversing the flangeway. Means are provided for rigidly fixing the spring wing rail at a point intermediate the free end and the closure rail engaging end wherein such point is spaced from the half inch point of frog that distance which will cause the spring wing rail to flex along its length from the half inch point of frog to the fixed point and move laterally a distance of approximately 2 inches from the long point rail at the half inch point of frog when a lateral force greater than approximately 500 pounds is applied to the spring wing rail by a rail car wheel flange in the flangeway.

BRIEF DESCRIPTION OF THE DRAWING

The drawing is a plan view of a right-hand spring rail frog constructed according to the instant invention shown inserted at the intersection of two running rails, each of which is associated with a pair of traffic rails.

DESCRIPTION OF THE PREFERRED EMBODIMENT

Figure 1:
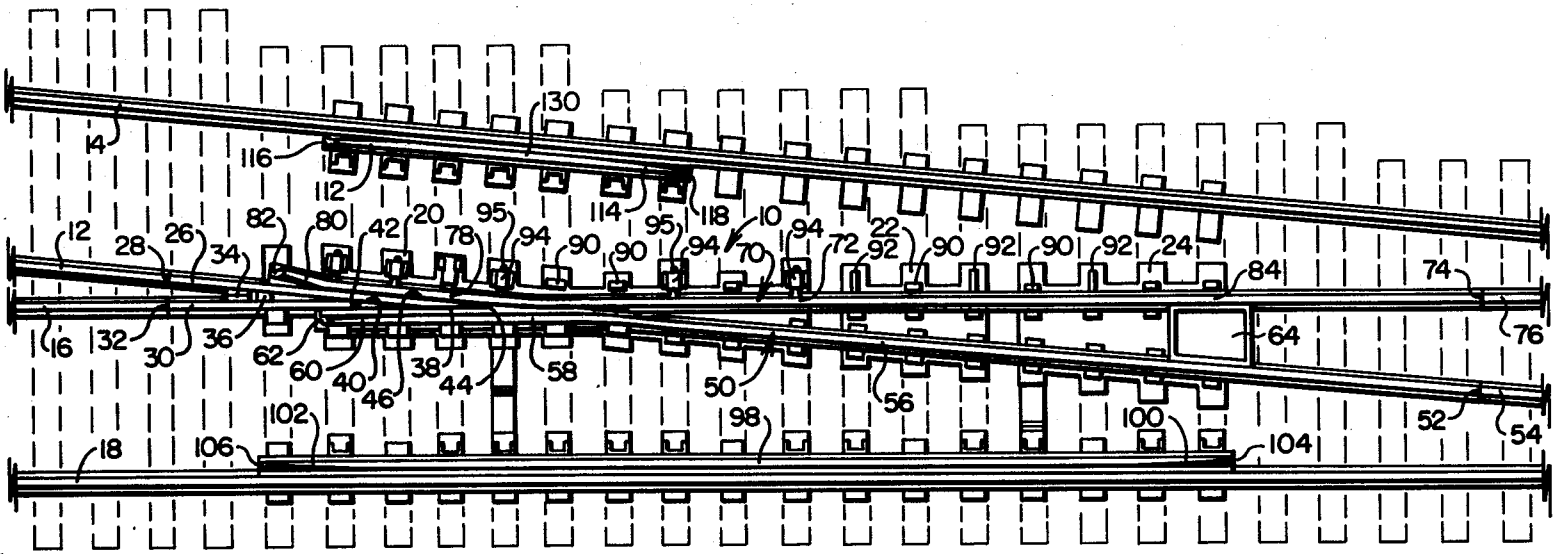

Referring to the drawing, right-hand spring rail frog 10 is shown inserted in one rail 12 of a pair of turn-out line rails 12, 14 and one rail 16 of a pair of main line rails 16, 18. Spring rail frog 10 is assembled and mounted on three base plates 20, 22, 24 which provide a level foundation for the frog and which maintain the elements which comprise the frog in their proper relationship during assembly, shipping and subsequent to installation.

A long point rail 26 is mounted on base plate 20 at the heel end of frog 10 and has a rail end 28 which is connected to turn out line rail 12 to provide a connection for that rail to frog 10. A short point rail 30 is mounted on base plate 20 and has a rail end 32 which is connected to main line rail 16 to connect that rail to frog 10. Long point rail 26 and short point rail 28 are mounted on base plate 20 at an angle which is known as the angle of frog. These rails 26, 30 are rigidly bolted to a heel block 34 which is inserted between them and mounted on base plate 20 near the apex of the rails 26, 30. Heel block 34 functions to maintain the angle and spacing between the long and short point rails 26, 30. A heel riser 36 is inserted between long and short point rails 26, 30 between heel block 34 and the apex of the rails to protect these rails from damage due to car wheels having false flanges. The false flange problem is described in detail in U.S. Pat. No. 4,362,282. Long point rail 26 terminates with a tapered surface 38 on one side which is substantially parallel with traffic rail 16. Short point rail 30 terminates with a tapered surface 40 which is complementary to and engages one side 42 of long point rail 26. The end 44 of long point rail 26 is approximately a half inch wide and is known as the half inch point of frog.

A rigid wing 50 having a rail end 52 which is connected to a curved closure rail 54 has a long body section 56 which is generally parallel with turn-out line rail 14 and an angled section 58 which is substantially parallel to short point rail 30. The end 60 of rigid wing rail 50 is flared so that the flange of a wheel moving along short point rail 30 toward frog 10 will not strike the tip 62 of the rigid wing rail 50. A spacer block 64 is rigidly mounted on base plate 24 at the toe end of frog 10. Rigid wing rail 50 is rigidly affixed to spacer block 64 by means of bolted connections which are well known. The rail end 52 of long body section 56 of rail 50 preferably extends at least six feet beyond spacer block 64 for reasons which will be described hereinafter. Rigid wing rail 50 also is rigidly secured to base plates 20, 22, 24 by conventional means such as plate clips. Thus, rigid wing rail 50 is a relatively immovable member of frog 10.

A flexible spring wing rail 70 which is the primary movable member of frog 10 has a straight, long body section 72 which terminates in a rail end 74 which is connected to a straight closure rail 76 as described hereinafter and an angled section 78 which is at the opposite end of body section 72. Angled section 78 is parallel to and engages the side 46 of long point rail 26 opposite that engaged by short point rail 30. The remote end 80 of angled section 78 is flared so that the tip 82 thereof is not struck by the flange of a car wheel moving from the long point rail 26 toward frog 10. Spring wing rail 70 is fixedly attached to spacer block 64 at a point 84 along straight body section 72 between rail end 74 and the free, angled section 78 by bolted connections which are well known. It is preferred that the rail end 74 of spring wing rail 70 project a minimum of approximately six feet beyond the point 84 of rigid attachment of spring wing rail 70 to spacer block 64 for reasons which will be disclosed hereinafter.

It should be emphasized that the rigid attachment of spring wing rail 70 to spacer block 64 is intended to prevent this point from acting as a hinge type of joint, i.e. rail 70 cannot pivot about its point of attachment to block 64. The spring wing rail 70 of the instant invention also is substantially longer than movable wing rails of previous frogs. This is because angled section 78 of spring wing rail 70 can only move laterally away from long point rail 26 by being flexed or bent away therefrom. In other words, the flange of a wheel acting against spring wing rail 70 either by traversing the long body section 56 of rigid wing rail 50 and engaging spring wing rail 70 at the juncture of its straight and angled sections or by traversing long point rail 26 and engaging angled section 78 of spring wing rail 70 must exert sufficient lateral force to bend spring wing rail 70 away from long point rail 26. Spring wing rail 70 must be bent sufficiently that it is spaced approximately 2 inches from the half inch point of frog. It has been found that the length of spring wing rail 70 from where it engages the long point rail 26 to point 84 where it is rigidly affixed to spacer block 64 should be such that wheel flanges exerting a lateral component of force on spring wing rail 70 at the half inch point of frog in the amount of at least 500 pounds will cause rail 70 to bend and move laterally a distance of 2 inches at that point. The 500 pound minimum force which will cause spring wing rail 70 to be displaced 2 inches at the half inch point of frog assumes that there are no other external forces acting to bias spring wing rail 70 against long point rail 26. If there are no external forces acting on spring wing rail 70 it will rest unstressed against long point rail 26.

Thus, when the flange of a wheel engages spring wing rail 70 and causes it to move laterally so that a flangeway is provided between long point rail 26 and spring wing rail 70, the rail 70 is stressed or flexed from the point of engagement to where it is attached to spacer block 64. It is acting essentially as a cantilevered beam with a force applied close to the free end thereof.

Although a 2 inch space between spring wing rail 70 and long point rail 26 at the half inch point of frog provides a sufficient flangeway for a wheel passing therebetween, spring wing rail 70 could be displaced a distance greater than 2 inches from long point rail 26 if a flange of a car wheel were to provide a relatively high impact to the spring wing rail 70 such as could occur if it was moving relatively fast. In order to limit the amount of bending of spring wing rail 70 to 2 inches at the half inch point of frog a plurality of stops 90, 92 and holddowns 94 are rigidly mounted on base plates 20, 22, 24 as by welding which stops are positioned to engage spring wing rail 70 at spaced points along its length when it is bent such that the lateral movement at the half inch point of frog is 2 inches. Stops 90 engage the base of spring wing rail 70 along its length from spacer block 64 when it is bent to its allowed maximum whereas stops 92 are configured to engage the web of spring wing rail 70. Thus, stops 92 in addition to limiting lateral movement of spring wing rail 70 also help to prevent vertical movement of rail 70. Conventional reinforcing strap (not shown) is bolted to spring wing rail 70 in a conventional manner from remote end 80 to the midpoint of straight body section 82. Such strap is shown in American Railway Engineering Association plan 490-82. An advantage of the reinforcing strap is that it provides a flat vertical surface facing outwardly away from rail 70 toward stops 90, 92. A plurality of holddown horns 95 attached to spring wing rail 70 protrude through holddowns 94 to restrain vertical movement of the spring wing rail 70. It should be noted that because there is no hinge where spring rail 70 is rigidly affixed to spacer block 64, the tendency of spring wing rail 70 to move vertically is greatly reduced since a solid rail and rigid connection is most resistant to vertical bending.

As previously mentioned, spring wing rail 70 is of such a length and construction as to require a minimum of 500 pounds of force acting laterally at the half inch point of frog to displace it 2 inches. As mentioned above, previous hinged rigid spring wing rails were biased toward engagement with long point rails by means of a spring box. A typical spring box exerts a force of approximately 700 pounds. It has been found that it is advantageous to use a spring box to bias flexible spring wing rail 70 against long point rail 26 even though the rail has a built-in spring bias when it is subjected to bending stress. The reason for this is that when a wheel flange disengages spring wing rail 70, the increased spring force caused by the bending stress of the rail 70 causes it to snap closed against long point rail 26. It has been found that there is sufficient spring force to cause spring wing rail 70 to crush small rocks which get between it and long point rail 26. Additionally, the increased spring force permits the use of longer spring wing rails.

As previously mentioned, it is preferred that rigid wing rail 50 and flexible spring wing rail 70 be fastened to curved and straight closure rails 54, 76, respectively, a substantial distance, preferably a minimum of six feet, from where the rigid and spring wing rails 50, 70 are fastened to spacer block 64. The reason for this is to make the rails 50, 70 extend sufficient distance from spacer block 64 that they can be welded to the respective closure rails 54, 76. The rigid and spring wing rails 50, 70 could also be attached to the curved and straight closure rails 54, 76 by rigid joints which are glued and bolted. However, welded joints are preferred for smoothness. The increased length of flexible spring wing rail 70 and its rigid attachment to straight closure rail 76 permitted by the lack of necessity for a hinged or pivoted joint provides a much smoother ride for a rail car across the frog 10. It is believed that this is because the natural frequency of the track is not interrupted. It has also been found that increasing the length of the long and short point rails 26, 70, respectively, to permit these rails to be welded to traffic rails 12, 16, respectively, also provides a smoother ride for a rail car across spring wing frog 10.

It has been found that because of the increased length of the spring wing rail 70 it is necessary to protect the rail 70 from lateral forces caused by skewed car wheels. Accordingly, it is preferred to have a guard rail 98 positioned on the guard side of main line rail 18. The guard rail should extend opposite flexible spring wing rail 70 from spacer block 64 to the tip 82 of spring wing rail 70. Additionally, the ends 100, 102 of guard rail 98 should be flared for a distance of approximately 4 feet with the tip 104, 106 of each flared end 100, 102 being located approximately 4 inches from the traffic rail 18. It is preferable that guard rail 98 be higher than traffic rail 18. Such a high guard rail is described in U.S. Pat. No. 3,964,679.

A second guard rail 130 is mounted on the guard side of turn-out line rail 14. Guard rail 130 has flared ends 112, 114 which terminate in tips 116, 118, respectively. Guard rail 130 extends approximately 3 ties on either side of the half inch point of frog. It is preferred that end 112 of guard rail 130 be positioned laterally opposite tip 82 of spring wing rail 70.

Since certain changes may be made in the above-described system and apparatus without departing from the scope of the invention herein involved, it is intended that all matter contained in the description or shown in the accompanying drawing shall be interpreted as illustrative and not in a limiting sense.

I claim:

1. A railroad frog assembly adapted to be inserted between a pair of traffic rails and a pair of closure rails which comprises:

a support means having a heel end and a toe end; a long point rail mounted on the heel end of the support means; a short point rail mounted on the heel end of the support means and joined to the long point rail at the angle of frog; a heel block mounted on the support means between the long point rail and the short point rail for maintaining the frog angle and spacing between the long point rail and the short point rail, a rigid wing rail mounted on the toe end of the support means having an angled end and a closure rail engaging end; a flexible spring wing rail mounted at the toe end of the support means having an angled section which is unrestrained laterally and which is movable laterally between a first position in which it engages the long point rail and a second position in which it is spaced from the long point rail to provide a flangeway therebetween, a closure rail engaging end and a remote end adjacent said angled section which terminates in a tip, wherein said tip is unrestrained from lateral movement and is displaced laterally away from the long point rail a first distance when said angled section engages said long point rail and is displaced laterally away from the long point rail a second distance which is greater than said first distance when said angled section is spaced from said long point rail; wherein the long point rail, the rigid wing rail and the spring wing rail cooperate to define the half inch point of frog; and means for rigidly fixing the spring wing rail to the support means at a point between the free end and the closure rail engaging end to prevent lateral and vertical movement of said spring wing rail at said point; wherein said point is spaced from the half inch point of frog that distance which will cause the spring wing rail to bend uniformly along its length from the point of fixation to the half inch point of frog and move laterally from the long point rail to the second position when a lateral force greater than approximately five hundred pounds is applied to the spring wing rail by a rail car wheel flange in the flangeway at the half inch point of frog.

2. The railroad frog of claim 1, wherein the closure rail engaging end of the spring wing rail is rigidly coupled to a closure rail beyond where the spring wing rail bends when it is in the second position.

3. The railroad frog of claim 2, wherein the spring wing rail is coupled to the closure rail a distance of greater than approximately five feet from the spacer block.

4. The railroad frog of claim 3 wherein the rail engaging end of the spring wing rail is welded to the closure rail.

5. A railroad frog assembly inserted between a first pair of rails and a second pair of rails which comprises;

a support means having a heel end and a toe end, a long point rail mounted on the heel end of the support means having one end connected to one of the first pair of traffic rails, a short point rail mounted on the heel end of the support means having one end connected to one of the second pair of rails, the other end of the short point rail joined to the other end of the long point rail at the angle of frog, a heel block mounted on the heel end of the support means between the long point rail and the short point rail for maintaining the frog angle and spacing between the long point rail and short point rail, a rigid wing rail mounted on the toe end of the support means having an angled end and a closure rail engaging end, and a flexible spring wing rail mounted at the toe end of the support means having an angled section which is unrestrained laterally and which is movable laterally between a first position in which it engages the long point rail and a second position in which it is spaced from the long point rail to provide a flangeway therebetween, a closure rail engaging end and a remote end adjacent said angled section which terminates in a tip, wherein said tip is unrestrained from lateral movement and is displaced laterally away from the long point rail a first distance when said angled section engages said long point rail and is displaced laterally away from the long point rail a second distance which is greater than said first distance when said angled section is spaced from said long point rail; wherein the long point rail, the rigid wing rail and the spring wing rail cooperate to define the half inch point of frog; wherein the flexible spring wing rail is in the first position when it is relatively unstressed and is in the second position when it is stressed in bending by lateral force applied to it by a rail car wheel traversing the flangeway; a spacer block mounted on the support means between the rigid wing rail and the spring wing rail, and means for rigidly affixing the spring wing rail to the spacer block at a point intermediate the free end and the closure rail engaging end to prevent lateral and vertical movement of said spring wing rail at said point; wherein said point is spaced from the half inch point of frog a distance which will cause the spring wing rail to bend uniformly along its length from the point of fixation to the half inch point of frog and move laterally from the long point rail to the second position when a lateral force greater than aproximately five hundred pounds is applied to the spring wing rail by a rail car wheel flange in the flangeway at the half inch point of frog; means for connecting the closure rail engaging end of the spring wing rail to a first closure rail beyond where the spring wing rail can bend; means for connecting the closure rail engaging end of the rigid wing rail to a second closure rail and a guard rail having a length substantially equal to the distance from the tip of said remote end of the spring wing rail to the spacer block mounted on the gauge side and adjacent one of the second pair of rails parallel to and laterally aligned with the spring wing rail from its tip to the spacer block.

* * * * *